US005249452A

United States Patent [19]

Baldwin et al.

[11] Patent Number: 5,249,452

[45] Date of Patent: Oct. 5, 1993

[54] ADJUSTABLE MASTER BRAKE DIE

[75] Inventors: John B. Baldwin, Warrenville; David R. Draper, Montgomery, both of Ill.

[73] Assignee: Caterpillar Inc., Peoria, Ill.

[21] Appl. No.: 18,671

[22] Filed: Feb. 17, 1993

[51] Int. Cl.[5] ..... B21D 5/02

[52] U.S. Cl. ..... 72/389; 72/446; 72/478; 72/481

[58] Field of Search ..... 72/389, 446, 478, 448, 72/381, 461, 481, 482, 413

[56] References Cited

U.S. PATENT DOCUMENTS

| | | | |
|---|---|---|---|
| 4,356,718 | 11/1982 | Makino | 72/389 |
| 4,366,698 | 1/1983 | Gill | 72/389 |
| 4,532,792 | 8/1985 | Hongo | 72/319 |
| 4,638,665 | 1/1987 | Benson et al. | 72/389 |
| 5,022,248 | 6/1991 | Brooks et al. | 72/21 |
| 5,040,401 | 8/1991 | Ireland | 72/389 |

*Primary Examiner*—David Jones
*Attorney, Agent, or Firm*—Kenneth A. Rhoads

[57] ABSTRACT

A master brake die has a pair of adjustable die shoes. First and second shim packages each having a plurality of shims of a preselected width are positioned adjacent a respective die shoe and moveable therewith. A preselected number of shims from each shim package is controllably moved into an operative position between a stop surface and a respective die shoe.

7 Claims, 5 Drawing Sheets

ADJUSTABLE MASTER BRAKE DIE

DESCRIPTION

1. Technical Field

This invention relates to a master brake die and more particularly to a pair of adjustable die shoes capable of being easily, quickly, and accurately positioned relative to one another to allow for selective forming of metal plate into prescribed shapes for different components.

2. Background Art

Large capacity master brake dies have always had a problem of preventing quick and accurate adjustment of the adjustable die shoes relative to one another. Forces generated in large capacity master brake dies during the bending process of relatively thick steel plate must pass directly through the die shoes. By necessity, the die shoes are very large for withstanding the imposed forces which makes it exceedingly difficult to move one die shoe relative to another when adjusting the gap between the die shoes for changing the angle of bend to be formed in the workpiece. Some positioning means which are sufficiently rugged to withstand the forces suffer from limitations in respect to versatility, ease of adjustment, complexity, and costliness.

Typically, accurate die shoe positioning involves bolting the die shoes to the base of the master brake die. To alter applications, the die shoe spacing is adjusted by screws and the shims of predetermined thickness are inserted between the outer sides of the die shoes and the master die base and then bolted to the base. Undesirably, a relatively large number of shims of various sizes must be on hand to accommodate the differing bend angles. Further, the shims can be relatively expensive and when not in use must be stored. Significantly, shims employed in some large master brake dies can themselves be exceedingly heavy making them difficult to handle and position in place. It, therefore, becomes evident that current shim arrangements do not provide a quick, inexpensive, and simple way of adjusting the spacing between the die shoes.

In attempts to overcome the above noted disadvantages, some master brake dies have been fitted with powered die shoes and powered rotary shims as taught is U.S. Pat. No. 5,022,248 which issued on Jun. 11, 1991 to Brooks et al. This type of system requires a separate hydraulic system which is often expensive.

Thus, what is needed is an adjustable die shoe assembly capably of being quickly and accurately adjustable. The present invention is directed to overcome one or more of the problems as set forth above.

DISCLOSURE OF THE INVENTION

In one aspect of the invention, there is provided an adjustable master brake die for bending plate material into different angular shapes. The adjustable master brake die has a base including a plurality of stops, and a pair of spaced apart die shoes mounted on the base forming an opening of a preselected width. Positioning means reciprocably move the shoes to various preselected positions. First and second shim packages, each having a plurality of shims, are positioned adjacent a respective shoe and moveable therewith. Selection means controllably preselect a number of the shims from each shim package and controllably moves the preselected number of shims from each shim package into an operable position between a respective stop and a respective die shoe.

BEST MODE FOR CARRYING OUT THE INVENTION

Figure 1:
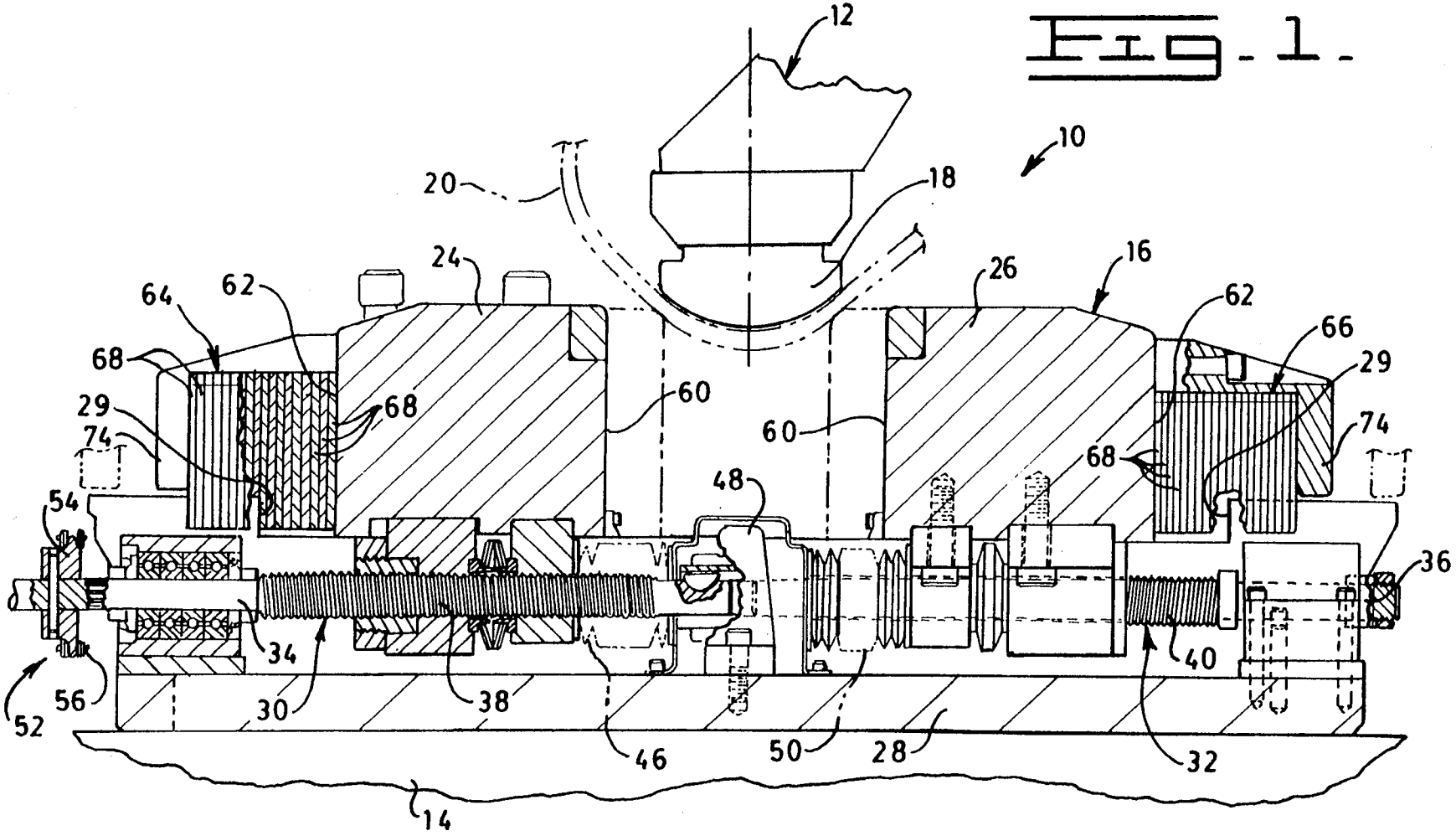
FIG. 1 is a diagrammatic cross-sectional view of the adjustable master brake die with a component shown by broken lines as being partially formed into a prescribed shape.
Figure 2:
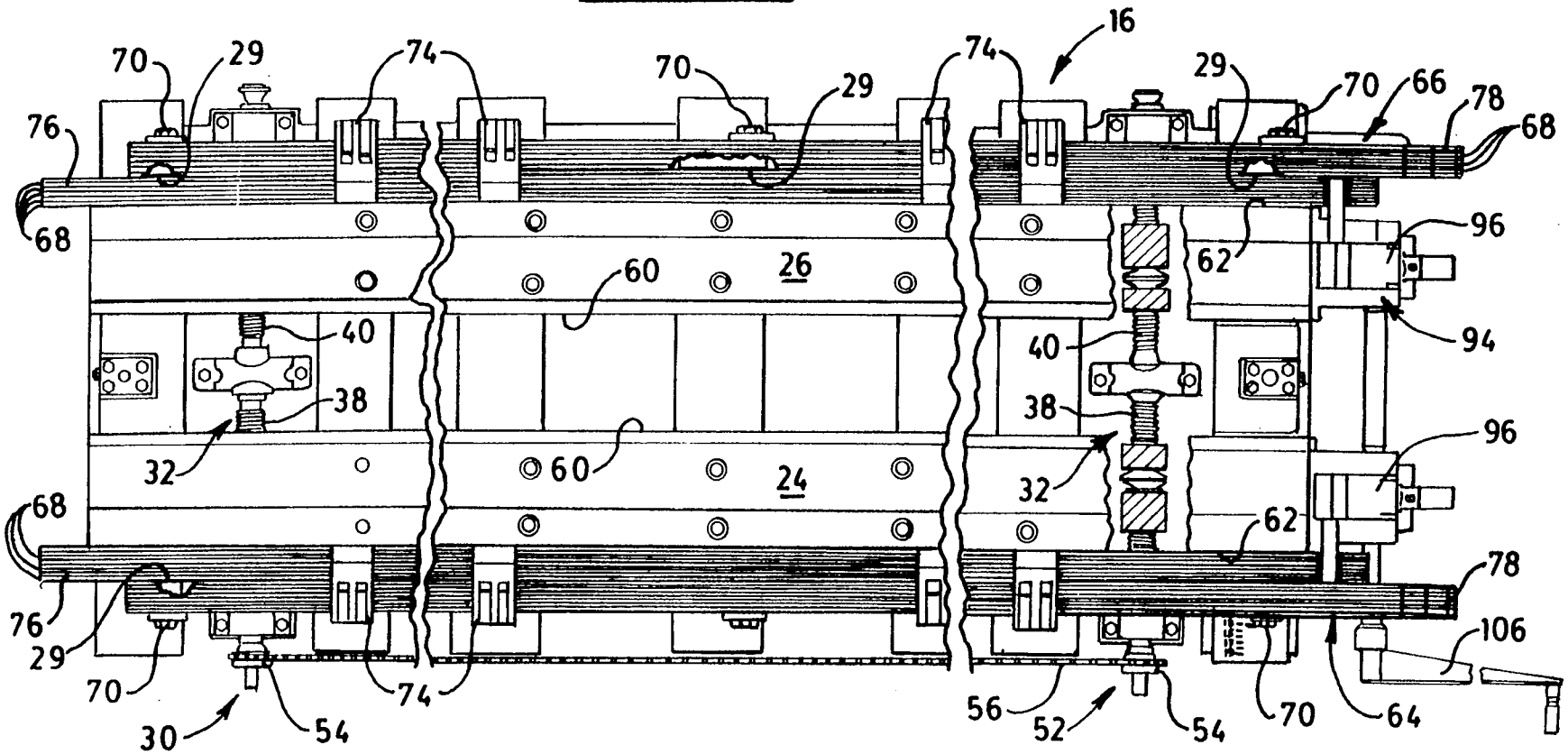
FIG. 2 is a diagrammatic partial plan top view of the adjustable master brake die.
Figure 3:
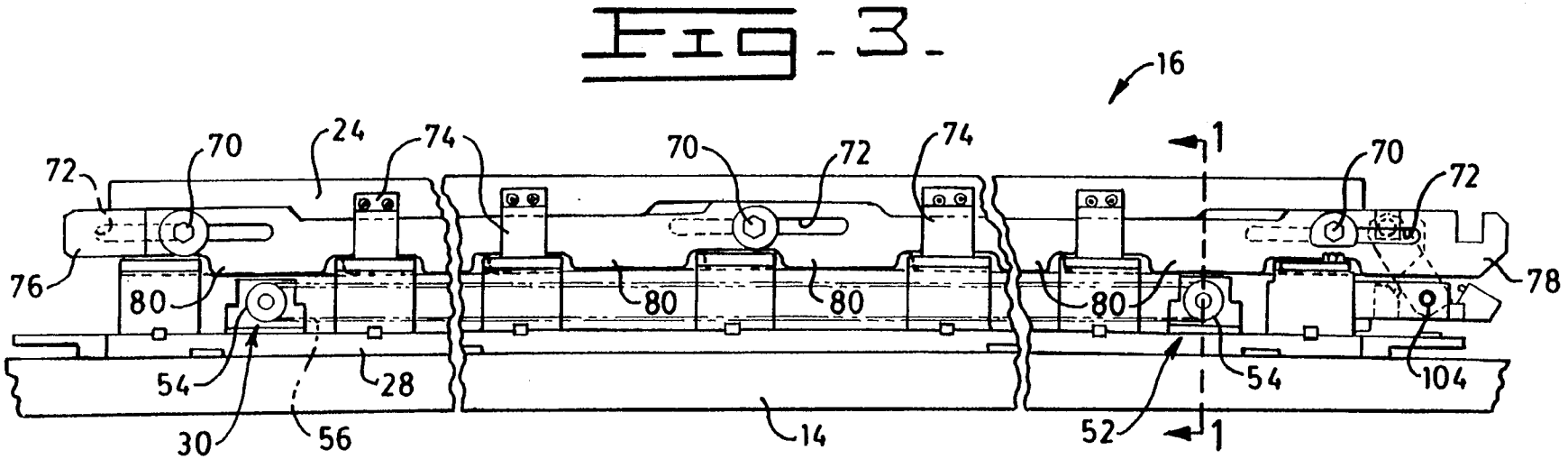
FIG. 3 is a diagrammatic partial side elevational view of the adjustable master brake die.

With reference to the drawings and particularly FIGS. 1, 2, and 3, a press brake 10 of the type suitable for bending and forming plate material into different angular shapes is disclosed. The press brake 10 has a ram assembly 12 and a bed 14. An adjustable master brake female die assembly 16 is secured to the bed 14 in a conventional manner. The ram assembly 12 includes a male die 18 arranged for conventional reciprocating movement toward and away from the female die assembly 16. The ram assembly 12 provides typically many tons of force so that a metal plate 20, shown by broken lines in FIG. 1, disposed between the male die 18 and the female die assembly 16 may be formed and/or bent to a desired shape, angle, configuration, or the like, in a conventional well known manner.

The female die assembly 16 includes a pair of elongate, spaced apart die shoes 24 and 26 and a base 28. The base 28 defines a plurality of stop surfaces 29 for each of the die shoes in a manner to be described later. In the specific instance, the length of the shoes 24 and 26 are approximately 3048 mm and the width of the opening between the die shoes may be varied from approximately 91 mm to 295 mm. The size and shape of the male die 18 and the die shoes 24 and 26 may be changed as needed to accommodate the particular metal stock being formed.

As illustrated in FIGS. 1 and 2, positioning means 30 is provided for reciprocably moving the die shoes 24 and 28 in opposed preselected directions in response to rotating a screw assembly 32. The positioning means 30 includes a screw assembly 32 threadably connected to the die shoes 24 and 26 and rotatably connected to the base 28. The screw assembly 32 has first and second axially aligned positioning shafts 34 and 36 operatively connected to rotate together. The positioning shafts 34 and 36 have first and second threaded end portions 38 and 40, each of an opposite thread lead to simultaneously move the die shoes 24 and 25 either toward each other or away from each other depending upon the direction of rotation of the screw assembly 32.

A plurality of Belleville springs 46 are disposed about the first shaft 34 between a fixed center support 48 for the positioning shafts 34 and 36 and the die shoe 24. A plurality of Belleville springs 50 are disposed about the second shaft 36 between the center support 48 and the die shoe 24.

Preferably, as shown in FIG. 2, there are at least two screw assemblies 32 disposed at opposite ends of the die shoes 24 and 26 and means 52 for simultaneously moving both screw assemblies. The means 52 includes a sprocket 54 operatively connected to each of the first positioning shafts 34 and an endless chain 56 encircling both sprockets.

Figure 4:
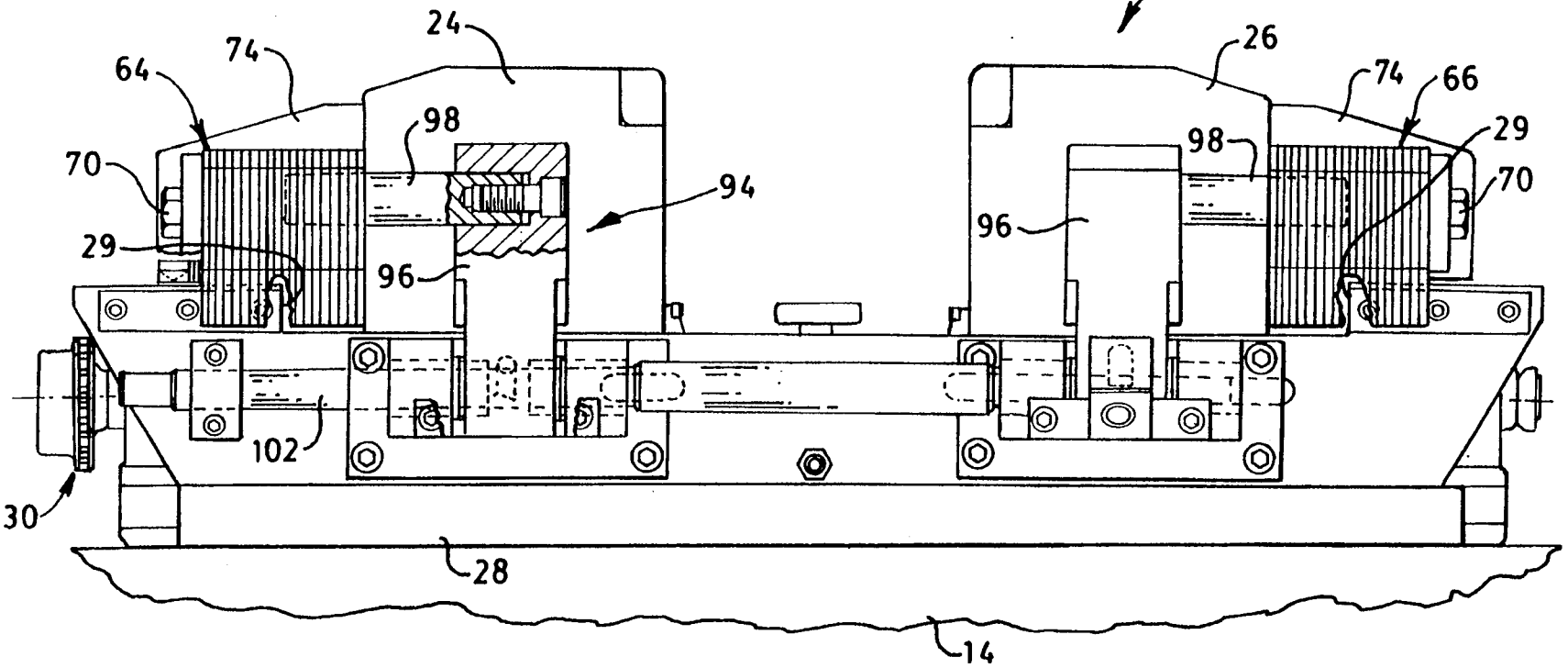
FIG. 4 is a diagrammatic cross-sectional view taken along section 6—6 of FIG. 3.

As can be seen in FIGS. 1, 2, and 4 the die shoes 24 and 26 each have an inner forming surface 60 and an outer mounting surface 62. First and second shim packages 64 and 66, each having a plurality of elongate shims 68, are positioned adjacent the outer surface 62 of the respective die shoe 24 and 26 and are moveable therewith. In the specific instance, each shim package 64 and 66 contains twenty shims 68. It is recognized that more or less shims 68 could be employed.

Each of the shim packages 64 and 66 are retained and guided for sliding movement along the base 28 by a plurality of bolts 70 that pass through a plurality of elongate slots 72 defined in each of the shims 68 and by a plurality of "L" shaped brackets 74 secured to the outer surface 62. Each of the shims 68 are perferably made of steel and in this specific instance approximately 5 mm thick.

Figure 5:
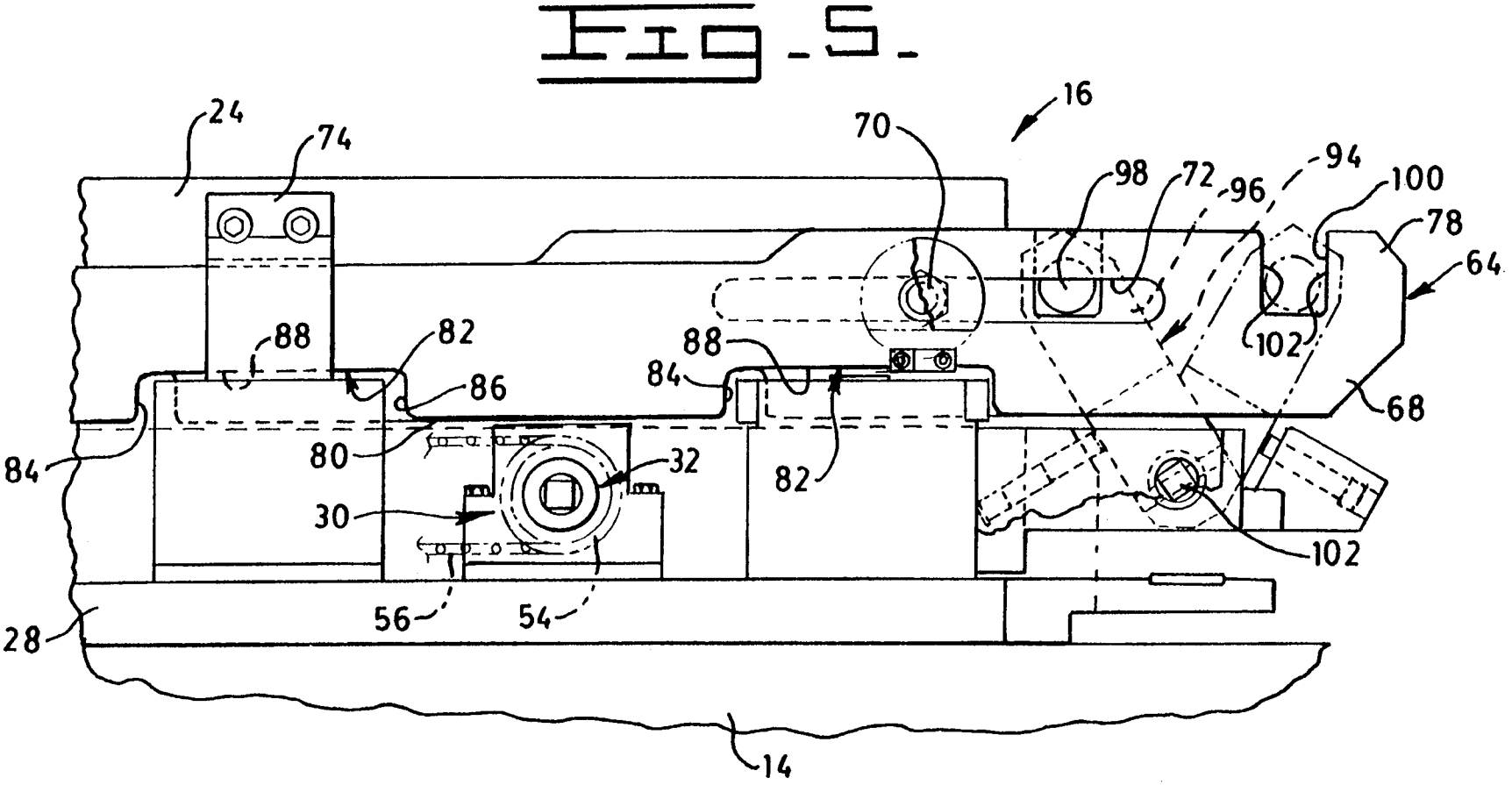
FIG. 5 is a diagrammatic side elevational view of the means for controllably moving the preselected number of shims from each shim package.

Each of the shims 68 have first and second shim end portions 76 and 78, and a lower shim portion 80. The lower shim portion has a plurality of cut out portions or notches 82 as best shown in FIGS. 2 and 5. Each cut out portion has a pair of generally parallel sidewalls 84 and 86 defining a preselected width and a bottom surface 88 defining a preselected depth.

Referring now to FIGS. 2, 4, and 5, selection means 94 controllably preselects a number of shims 66 from each shim package 64 and 66 in response to the preselected positions of the respective die shoe 24 and 26. The selection means 94 controllably moves the preselected number of shims 68 from each shim package 64 and 66 into an operable position between a respective stop surface 29 and a respective die shoe 24 and 26 at the various preselected positions of the die shoe.

The selection means 94 includes a pair of lever arms 96 pivotally connected to the base 28 and a bar 98 extending outwardly from each lever arm. In the preferred embodiment, the bar 98 has a length at least as great as the width of its respective shim package 64 and 66. A slot 100 having side surfaces 102 is defined in the second end 78 of each of the shims 68. The selected shims 68 are moved by the bar 98 engaging the respective side surfaces 102. As best shown in FIG. 5, the lever arms 96 are interconnected by a lever arm shaft 104. The lever arm shaft 104 is rotated by, for example, a crank 106.

INDUSTRIAL APPLICABILITY

In operation, each die shoe 24 and 26 and associated shim package 64 and 66 preferably have a plurality of spaced apart stop surfaces 29 which are connected to the base 28. The positioning means 30 including the screw assembly 32 moves the die shoes 24 and 26 to various preselected positions creating a space of a preselected width between the outer surface 62 of the respective die shoe and the respective stop surface 29.

The plurality of shims 68 forming the first and second shim packages 66 are mounted on the respective die shoes 24 and 26 and moveable therewith. The lower shim portion 80 of each shim 68 has a cut-out portion for passage of the stop surface 29 therethrough during movement of the associated shoes 24 and 26. Preselected numbers of the shims 68 from each shim package 64 and 68 are sequentially moved between the outer surface 62 and the stop surface 29 of the die shoes 24 and 26.

Pivoting of the selection means 94 for placing the preselected number of shims 68 at an operating position results in the bar 98 contacting the correct number of shims, sliding these shims along the base 28 of the master die assembly 16 to a position at which the stop surface 29 is adjacent and abutting the portion between the cutouts of the lower shim portion 80 of the selected shims 68 as best shown in FIGS. 2 and 5.

In this manner, the die shoes 24 and 26 are readily, quickly, and accurately adjusted relative to one another to form a plate of steel or other material into a shape prescribed by the design of the component.

Other aspects, objects, and advantages become apparent from a study of the specification, drawings, and appended claims.

We claim:

1. An adjustable master brake die for bending plate material into different angular shapes, the adjustable master brake die has a base having a plurality of stop surfaces, a pair of spaced apart die shoes mounted on the base forming an opening of a preselected width, the improvement comprising:

positioning means for reciprocably moving the die shoes to various preselected positions;

first and second shim packages each having a plurality of shims, each shim package being positioned adjacent a respective die shoe and moveable therewith; and;

selection means for controllably preselecting a number of the shims from each shim package in response to the preselected positions of the respective die shoe and controllably moving the preselected number of shims from each package each into an operable position between a respective stop surface and a respective die shoe at the various preselected positions of the die shoe.

2. The adjustable master brake die of claim 1, wherein the positioning means including a screw assembly threadably connected to the die shoes and rotatably connected to the base.

3. The adjustable master brake die of claim 1, wherein the screw assembly has first and second threaded end portions, each of an opposite thread lead.

4. The adjustable master brake die of claim 3, wherein there are at least two screw assemblies and means for simultaneously moving both screw assemblies.

5. The adjustable master brake die of claim 4, wherein the means for simultaneously moving both screw assemblies includes a sprocket and an endless chain encircling both sprockets.

6. The adjustable master brake die of claim 1, wherein the selection means includes a pair of levers arm pivotally connected to the base and a bar extending outwardly from each of the lever arms.

7. The adjustable master brake die of claim 6, wherein the bar has a length at least as great as the width of its respective shim package.

* * * * *